US005351477A

United States Patent [19]

Joshi et al.

[11] Patent Number: 5,351,477

[45] Date of Patent: Oct. 4, 1994

[54] DUAL FUEL MIXER FOR GAS TURBINE COMBUSTOR

[75] Inventors: Narendra D. Joshi, Cincinnati; Eric J. Kress, Loveland, both of Ohio

[73] Assignee: General Electric Company, Cincinnati, Ohio

[21] Appl. No.: 170,969

[22] Filed: Dec. 21, 1993

[51] Int. Cl.[5] ..... F02C 3/20; F23R 3/32

[52] U.S. Cl. ..... 60/39.463; 60/737; 60/742; 60/748; 239/400; 239/403; 239/430

[58] Field of Search ..... 60/737, 738, 739, 742, 60/748, 740, 39.463; 431/9, 185, 187; 239/403, 416.4, 416.5, 423, 424.5, 425.5, 400, 430

[56] References Cited

U.S. PATENT DOCUMENTS

| | | | |
|---|---|---|---|
| 3,713,588 | 1/1973 | Sharpe | 239/400 |
| 3,866,413 | 2/1975 | Sturgess | 239/403 |
| 3,910,037 | 10/1975 | Salkeld | 60/39.463 |
| 3,912,164 | 10/1975 | Lefebvre et al. | 60/748 |
| 3,917,173 | 11/1975 | Singh | 239/430 |
| 3,980,233 | 9/1976 | Simmons et al. | 239/400 |
| 4,023,351 | 5/1977 | Beyler et al. | 60/748 |
| 4,222,243 | 9/1980 | Mosby | 60/748 |
| 4,237,694 | 12/1980 | Wood et al. | 60/738 |
| 4,425,755 | 1/1984 | Hughes | 60/742 |
| 4,598,553 | 7/1986 | Saito et al. | 60/748 |
| 4,701,124 | 10/1987 | Maghon et al. | 60/748 |
| 5,062,792 | 11/1991 | Maghon | 239/403 |
| 5,165,241 | 11/1992 | Joshi et al. | 60/737 |
| 5,251,447 | 10/1993 | Joshi et al. | 239/403 |

OTHER PUBLICATIONS

"Gas Turbine Combustion", by Arthur H. Lefebvre, Purdue University, 1983, pp. 420–422 and pp. 445–448.

*Primary Examiner*—Timothy S. Thorpe

*Attorney, Agent, or Firm*—Jerome C. Squillaro; David L. Narciso

[57] ABSTRACT

A dual fuel mixer is disclosed having a mixing duct, a shroud surrounding the upstream end of the mixing duct having contained therein a gas fuel manifold and a liquid fuel manifold in flow communication with a gas fuel supply and a liquid fuel supply, respectively, and control means, a set of inner and outer annular counter-rotating swirlers adjacent the upstream end of the mixing duct, where at least the outer annular swirlers include hollow vanes with internal cavities and gas fuel passages, all of which are in fluid communication with the gas fuel manifold to inject gas fuel into the air stream, the vane cavities also having liquid fuel passages therethrough in fluid communication with the liquid fuel manifold, and a hub separating the inner and outer annular swirlers to allow independent rotation thereof, the hub having a circumferential slot in fluid communication with the liquid fuel passages which injects liquid fuel into the air stream, wherein high pressure air from a compressor is injected into the mixing duct through the swirlers to form an intense shear region and gas fuel is injected into the air stream from the outer annular swirler vanes and/or liquid fuel is injected into the air stream from the hub slot.

24 Claims, 9 Drawing Sheets

DUAL FUEL MIXER FOR GAS TURBINE COMBUSTOR

BACKGROUND OF THE INVENTION

1. Field of the Invention

The present invention relates to an air fuel mixer for the combustor of a gas turbine engine, and, more particularly, to a dual fuel mixer for the combustor of a gas turbine engine which uniformly mixes either liquid and/or gaseous fuel with air so as to reduce NOx formed by the ignition of the fuel/air mixture.

2. Description of Related Art

Air pollution concerns worldwide have led to stricter emissions standards requiring significant reductions in gas turbine pollutant emissions, especially for industrial and power generation applications. Nitrogen Oxides (NOx), which are a precursor to atmospheric pollution, are generally formed in the high temperature regions of the gas turbine combustor by direct oxidation of atmospheric nitrogen with oxygen. Reductions in gas turbine emissions of NOx have been obtained by the reduction of flame temperatures in the combustor, such as through the injection of high purity water or steam in the combustor. Additionally, exhaust gas emissions have been reduced through measures such as selective catalytic reduction. While both the wet techniques (water/steam injection) and selective catalytic reduction have proven themselves in the field, both of these techniques require extensive use of ancillary equipment. Obviously, this drives the cost of energy production higher. Other techniques for the reduction of gas turbine emissions include "rich burnt quick quench, lean burn" and "lean premix" combustion, where the fuel is burned at a lower temperature.

In a typical aero-derivative industrial gas turbine engine, fuel is burned in an annular combustor. The fuel is metered and injected into the combustor by means of multiple nozzles along with combustion air having a designated amount of swirl. No particular care has been exercised in the prior art, however, in the design of the nozzle or the dome end of the combustor to mix the fuel and air uniformly to reduce the flame temperatures. Accordingly, non-uniformity of the air/fuel mixture causes the flame to be locally hotter, leading to significantly enhanced production of NOx.

In the typical aircraft gas turbine engine, flame stability and engine operability dominate combustor design requirements. This has in general resulted in combustor designs with the combustion at the dome end of the combustor proceeding at the highest possible temperatures at stoichiometric conditions. This, in turn, leads to large quantities of NOx being formed in such gas turbine combustors since it has been of secondary importance.

While premixing ducts in the prior art have been utilized in lean burning designs, they have been found to be unsatisfactory due to flashback and auto-ignition considerations for modern gas turbine applications. Flashback involves the flame of the combustor being drawn back into the mixing section, which is most often caused by a backflow from the combustor due to compressor instability and transient flows. Auto-ignition of the fuel/air mixture can occur within the premixing duct if the velocity of the air flow is not fast enough, i.e., where there is a local region of high residence time. Flashback and auto-ignition have become serious considerations in the design of mixers for aero-derivative engines due to increased pressure ratios and operating temperatures. Since one desired application of the present invention is for the LM6000 gas turbine engine, which is the aero-derivative of General Electric's CF6-80C2 engine, these considerations are of primary significance.

U.S. Pat. No. 5,165,241, which is owned by the assignee of the present invention, discloses an air fuel mixer for gas turbine combustors to provide uniform mixing which includes a mixing duct, a set of inner and outer annular counter-rotating swirlers at the upstream end of the mixing duct and a fuel nozzle located axially along and forming a centerbody of the mixing duct, wherein high pressure air from a compressor is injected into the mixing duct through the swirlers to form an intense shear region and fuel is injected into the mixing duct through the centerbody. However, this design is useful only for the introduction of gaseous fuel to the combustor.

U.S. Pat. No. 5,251,447, which is also owned by the assignee of the present invention, describes an air fuel mixer similar to that disclosed and claimed herein and is hereby incorporated by reference. The dual fuel mixer of the present invention, however, is different from the air fuel mixer of the '447 patent in that it provides separate fuel manifolds and passages to allow the injection of gas and/or liquid fuel.

SUMMARY OF THE INVENTION

In accordance with one aspect of the present invention, a dual fuel mixer is disclosed having a mixing duct, a shroud surrounding the upstream end of the mixing duct having contained therein a gas fuel manifold and a liquid fuel manifold in flow communication with a gas fuel supply and a liquid fuel supply, respectively, and control means, a set of inner and outer annular counter-rotating swirlers adjacent the upstream end of the mixing duct, where at least the outer annular swirlers include hollow vanes with internal cavities and gas fuel passages, all of which are in fluid communication with the gas fuel manifold to inject gas fuel into the air stream, the vane cavities also having liquid fuel passages therethrough in fluid communication with the liquid fuel manifold, and a hub separating the inner and outer annular swirlers to allow independent rotation thereof, the hub having a circumferential slot in fluid communication with the liquid fuel passages which injects liquid fuel into the air stream, wherein high pressure air from a compressor is injected into the mixing duct through the swirlers to form an intense shear region and gas fuel is injected into the air stream from the outer annular swirler vanes and/or liquid fuel is injected into the air stream from the hub slot so that the high pressure air and the fuel is uniformly mixed therein so as to produce minimal formation of pollutants when the fuel/air mixture is exhausted out the downstream end of the mixing duct into the combustor and ignited.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
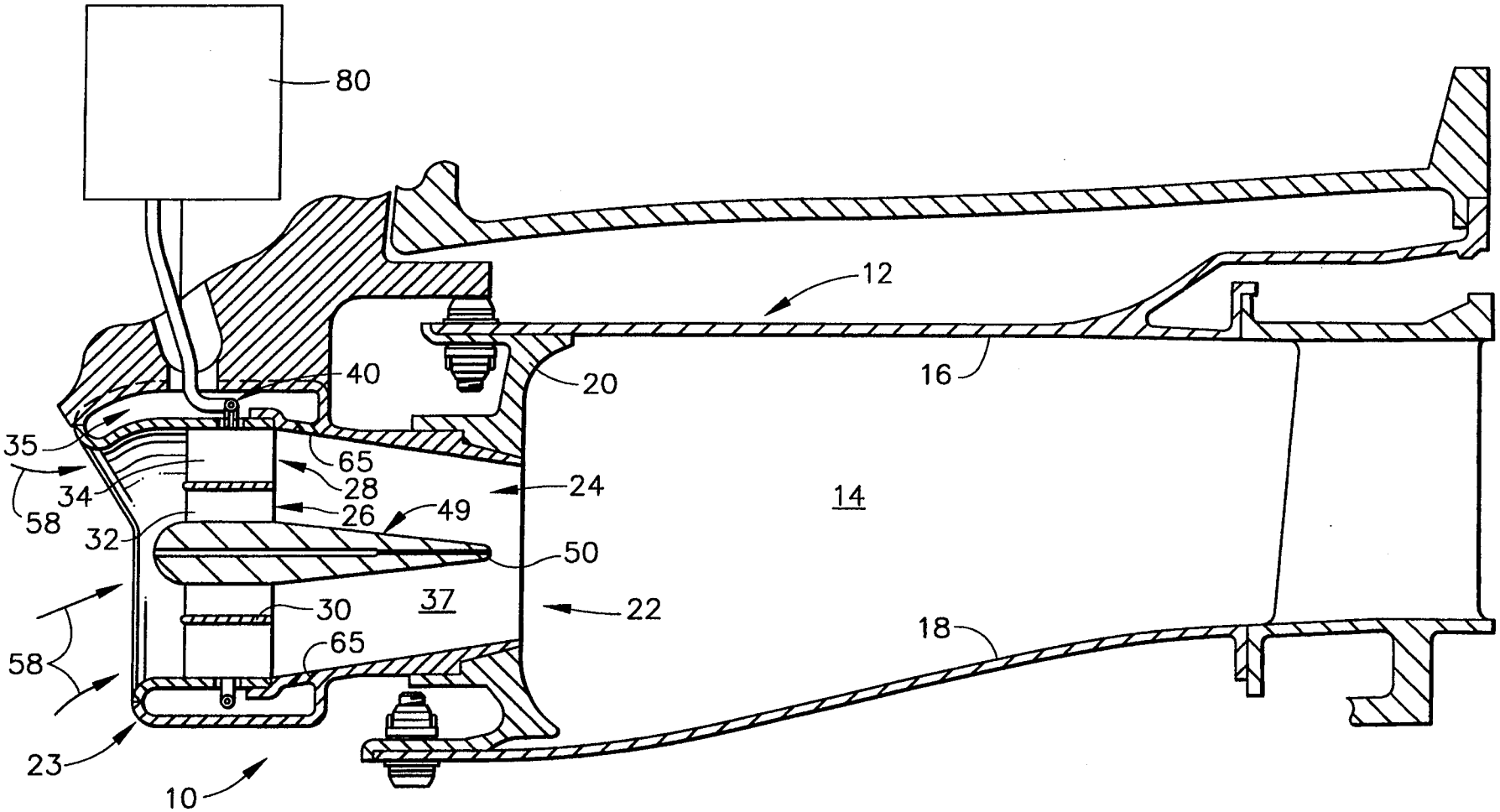
FIG. 1 is a cross-sectional view through a single annular combustor structure including the dual fuel mixer of the present invention.

Referring now to the drawings in detail, wherein identical numerals indicate the same elements throughout the figures, FIG. 1 depicts a continuous burning combustion apparatus 10 of the type suitable for use in a gas turbine engine and comprising a hollow body 12 defining a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well-known cylindrical can or cannular type, as well as combustors having a plurality of annuli. In the present annular configuration, the domed end 20 of hollow body 12 includes a swirl cup 22, having disposed therein a dual fuel mixer 24 of the present invention to allow the uniform mixing of gas and/or liquid fuel and air therein. Accordingly, the subsequent introduction and ignition of the fuel/air mixture in combustion chamber 14 causes a minimal formation of pollutants. Swirl cup 22, which is shown generally in FIG. 1, is made up of mixer 24 and the swirling means described below.

Figure 2:
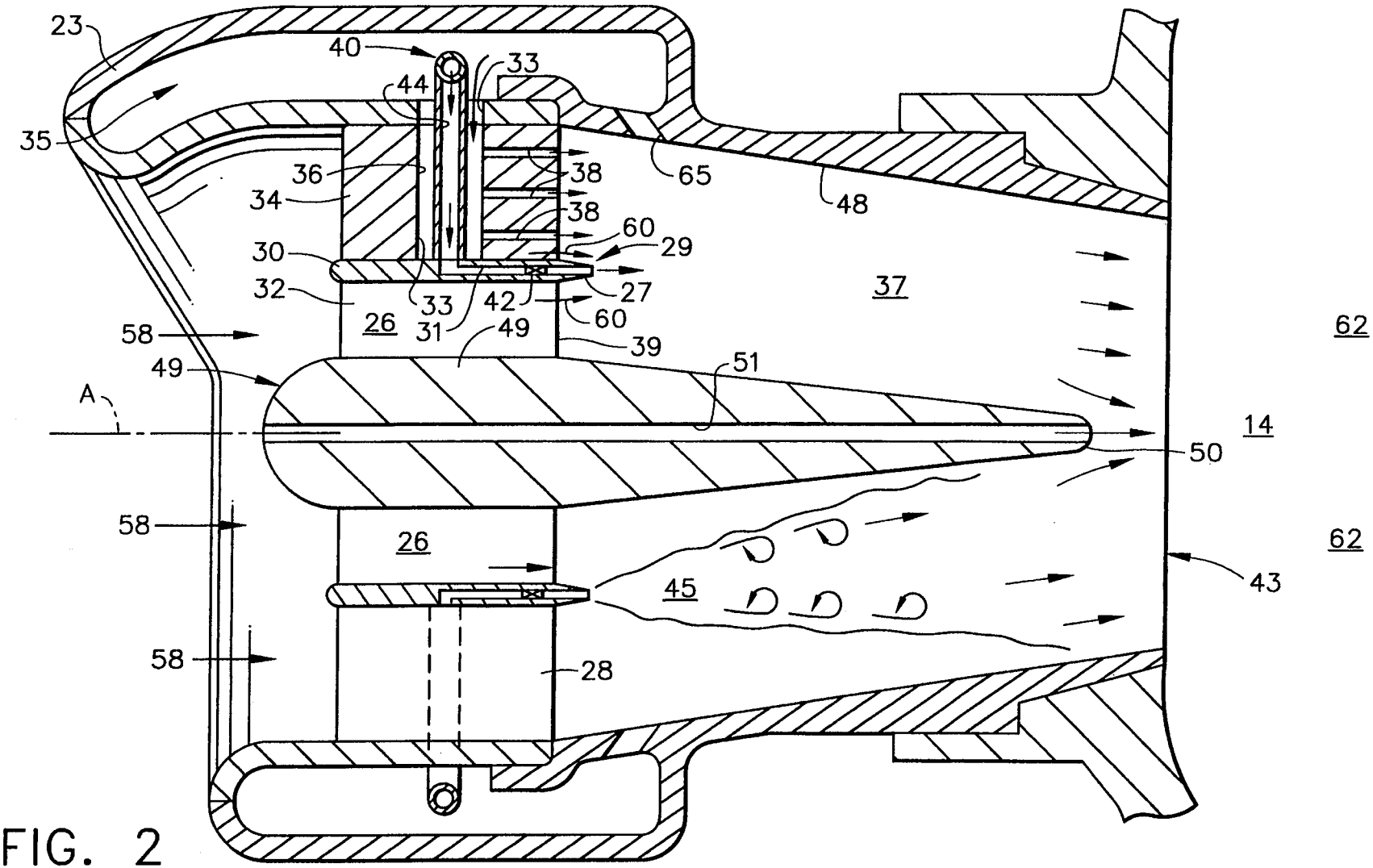
FIG. 2 is an enlarged cross-sectional view of the dual fuel mixer of the present invention and combustor dome portion of FIG. 1 which depicts the fuel and air flow therein.
Figure 3:
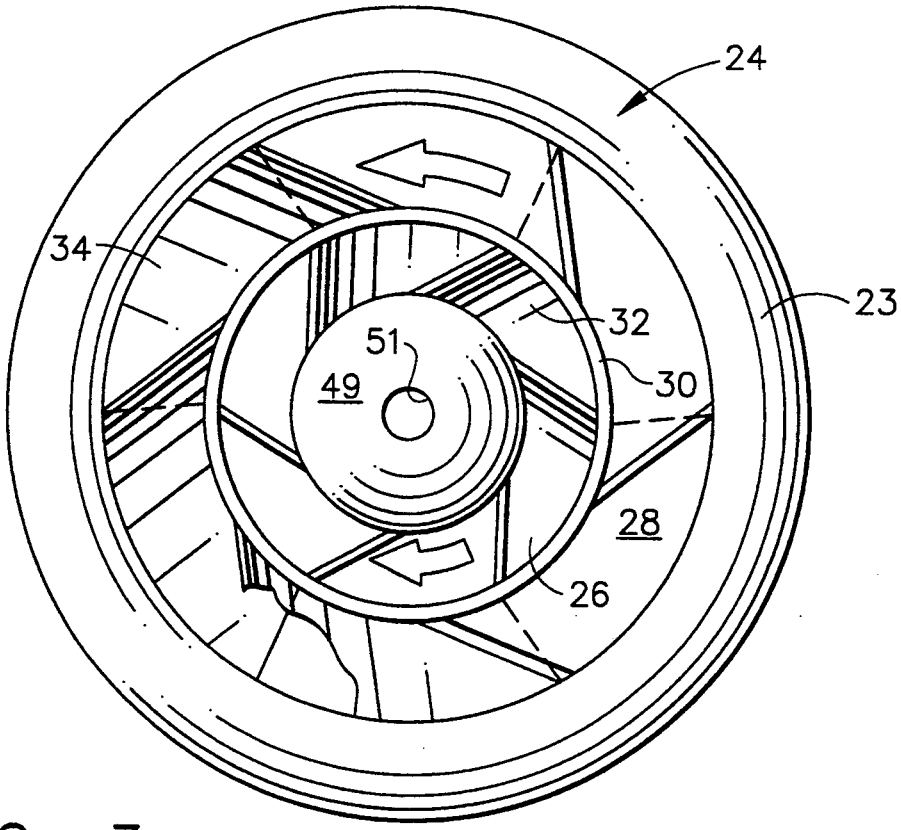
FIG. 3 is a front view of the air fuel mixer depicted in FIG. 2 of the present invention.
Figure 6:
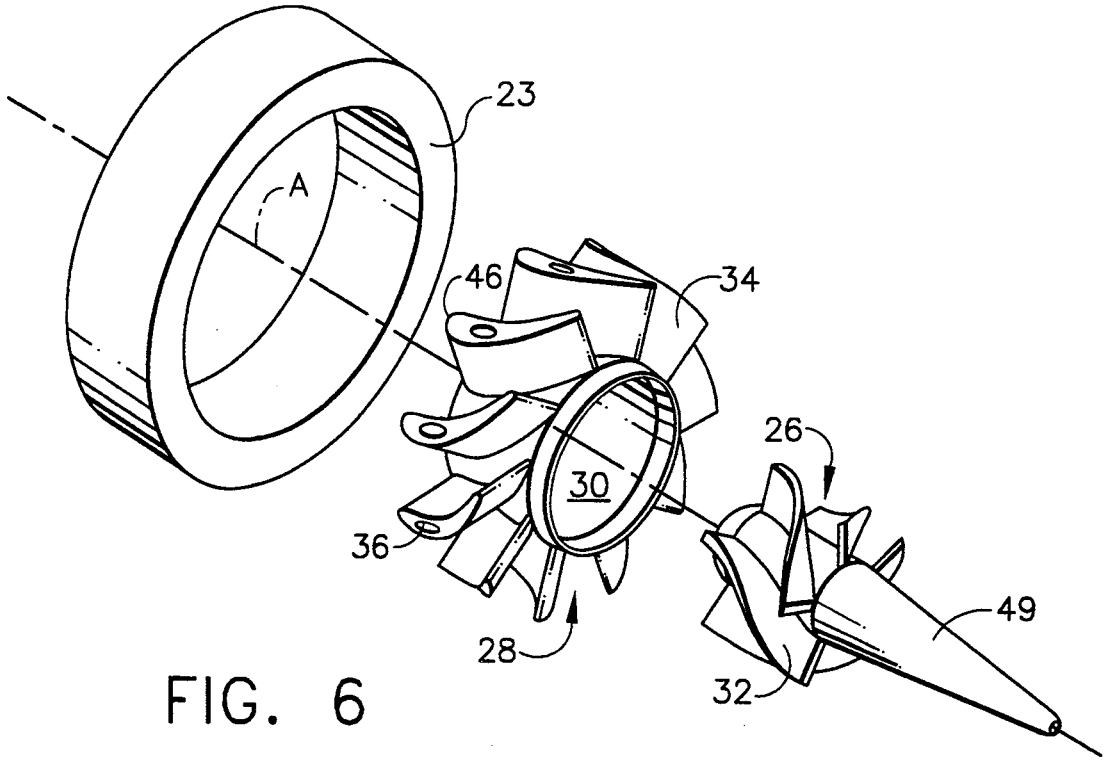
FIG. 6 is an exploded perspective view of the duel fuel mixer depicted in FIG. 2, where the passages in the shroud and hub are not shown for clarity.
Figure 9:
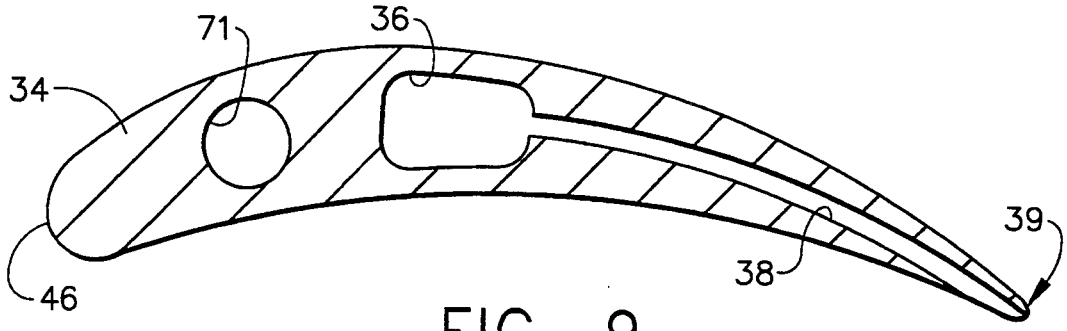
FIG. 9 is a cross-sectional view of a vane in the outer swirler of FIG. 8.

As best seen in FIGS. 1 and 2, mixer 24 includes inner swirler 26 and outer swirler 28 which are brazed or otherwise set in swirl cup 22, where inner and outer swirlers 26 and 28 preferably are counter-rotating (see orientation of their respective vanes in FIG. 3). It is of no significance which direction inner swirler 26 and outer swirler 28 causes air to rotate so long as it does so in opposite directions. Inner and outer swirlers 26 and 28 are separated by a hub 30, which allows them to be co-annular and separately rotate the air therethrough. As depicted in FIGS. 1 and 2, inner and outer swirlers 26 and 28 are preferably axial, but they may be radial or some combination of axial and radial, It will be noted that swirlers 26 and 28 have vanes 32 and 34 (see FIG. 3) at an angle in the 40°–60° range with an axis A running through the center of mixer 24 (see FIGS. 1, 2 and 6). Also, the air mass ratio between inner swirler 26 and outer swirler 28 is preferably approximately 1:3.

As best seen in FIGS. 1 and 2, a shroud 23 is provided which surrounds mixer 24 at the upstream end thereof with a gas fuel manifold 35 and a liquid fuel manifold 40 contained therein, Downstream of inner and outer swirlers 26 and 28 is an annular mixing duct 37. Gas fuel manifold 35 is in flow communication with vanes 34 of outer swirler 28 and is metered by an appropriate fuel supply and control mechanism 80. Although not depicted in the figures, gas fuel manifold 35 could be altered so as to be in flow communication with vanes 32 of inner swirler 26.

Figure 4A:
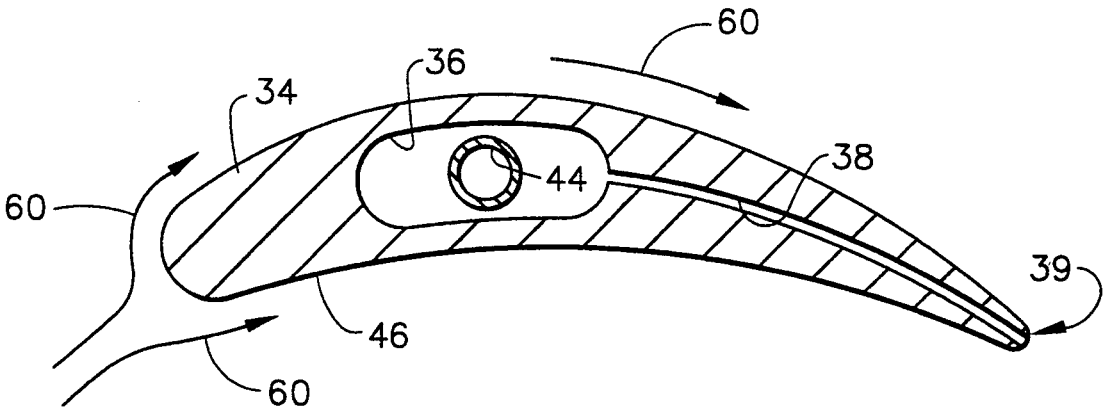
FIG. 4A is a cross-sectional view of a vane in the outer swirler of FIGS. 2 and 3 depicting the fuel passages from the internal cavity to the trailing edge and the liquid fuel passage through the internal cavity.
Figure 4B:
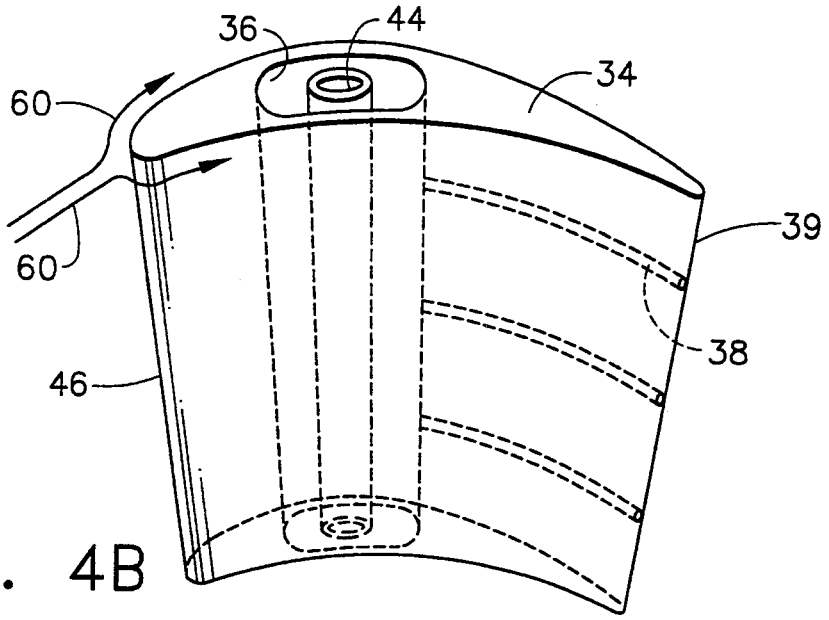
FIG. 4B is a perspective view of the vane in FIG. 4B.

More particularly, vanes 34 are of a hollow design as shown in FIGS. 4*a* and 4*b*. As depicted therein, vanes 34 have an internal cavity 36 therethrough located adjacent the larger leading edge portion 46 which is in flow communication with fuel manifold 35 by means of gas fuel passage 33. Preferably, each of vanes 34 has a plurality of passages 38 from internal cavity 36 to trailing edge 39 of such vane, Passages 38 may be drilled by lasers or other known methods, and are utilized to inject gaseous fuel into the air stream at trailing edge 39 so as to improve macromixing of the fuel with the air. Passages 38, which have a diameter of approximately 0.6 millimeter (24 mils), are sized in order to minimize plugging therein while maximizing air/fuel mixing. The number and size of passages 38 in vanes 34 is dependent on the amount of fuel flowing through gas fuel manifold 35, the pressure of the fuel, and the number and particular design of the vanes of swirlers 26 and 28; however, it has been found that three passages work adequately.

Gas fuel passages 38 may also extend from vane internal cavity 36 either a distance downstream or merely through leading edge portion 46 to terminate substantially perpendicular to a pressure surface or a suction surface of vane 34. These alternate embodiments have the advantage of allowing the energy of the air stream contribute to mixing so long as the passages terminate substantially perpendicular to air stream 60.

A separate liquid fuel manifold 40, as best seen in FIG. 2, is preferably positioned within gas fuel manifold 35 and is also metered by fuel supply and control mechanism 80. Liquid fuel passages 44 are provided through internal cavity 36 of vanes 34 and are in fluid communication with liquid fuel manifold 40. Hub 30 includes a circumferential slot 31, which in the preferred embodiment extends to the downstream end 29 thereof (see FIGS. 2 and 5), which is in fluid communication with liquid fuel passages 44 to enable injection of liquid fuel into the air stream. It will be noted that liquid fuel passages 44 preferably enter internal cavity 36 through the gas fuel passage 33. Accordingly, liquid fuel manifold 40 and liquid fuel passages 44 are insulated from hot compressor discharge air which significantly reduces the likelihood of fuel coking within liquid fuel passages 44.

Figure 5:
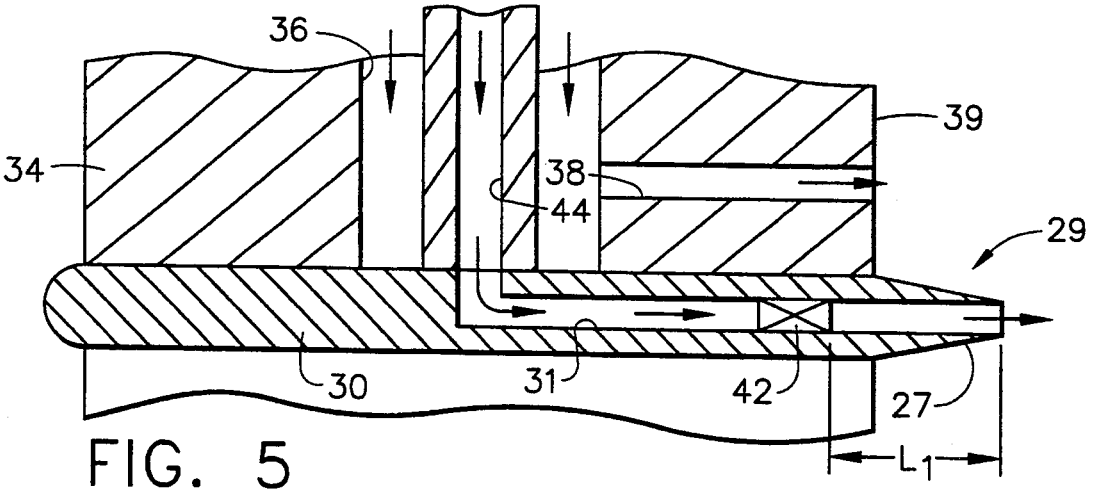
FIG. 5 is a partial cross-sectional view of the dual fuel mixer of FIG. 2.

As shown in FIGS. 2 and 5, it is preferred that downstream end 29 of hub 30 extend downstream of vanes 34 to ensure that the air flow on either side thereof is attached. In addition, downstream end 29 of hub 30 has a sharp chamfered edge 27, which ensures that the aft facing recirculation zone is extremely small. A swirler 42 may also be positioned within circumferential slot 31 in order to impart a swirl to the liquid fuel film ejected from hub 30 at downstream end 29. This swirl helps to break the liquid fuel film and mix the liquid fuel with the air stream 60. Since the fuel exiting swirler 42 will initially be in the form of several jets, the length $L_1$ of circumferential slot 31 therefrom to hub downstream 29 preferably is sized so as to allow the fuel jets to coalesce into a rotating uniform film of liquid fuel. It will be understood that the length $L_1$ for a given application is dependent on several factors, including but not limited to the viscosity, density and velocity of the liquid fuel. Accordingly, injection of the liquid film in the intense shear region 45 formed by the counter-rotating air streams causes it to break up and vaporize rapidly due to the intense mixing provided therein.

Figure 5A:
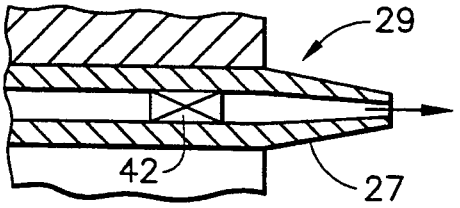
FIG. 5A is a partial enlarged cross-sectional view of an alternative hub design.
Figure 5B:
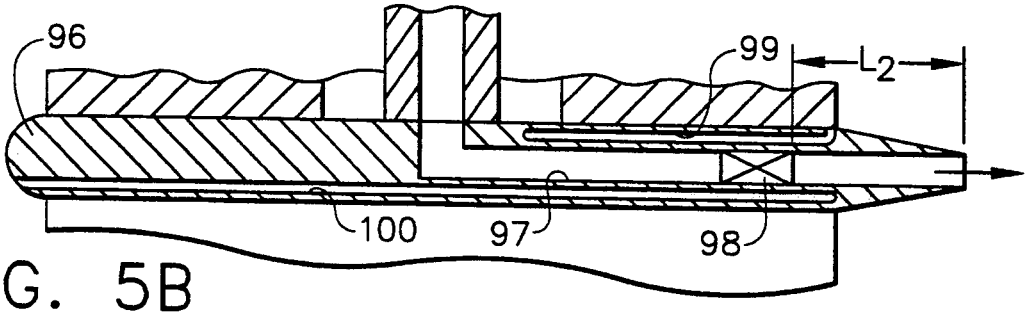
FIG. 5B is a partial cross-sectional view of the dual fuel mixer of FIG. 2, where air passages have been included in the hub.

Alternative embodiments for hub 30 are depicted in FIGS. 5A and 5B. As shown in FIG. 5A, circumferential slot 31 may be uniformly converging downstream of swirler 42 to hub downstream end 29 in order to increases fuel velocity, prevent backflow, and prevent boundary layers from building up on the slot walls. Additionally, FIG. 5B discloses an alternative hub 96 which includes a circumferential slot 97 and swirler 98 therein. Also provided in the hub 96 are upper and lower air cavities 99 and 100, respectively, on either side of circumferential slot 97, which extends insulation to the liquid fuel in hub 96 and prevents the liquid fuel from reaching an unacceptable temperature. As seen in FIG. 5B, upper air cavity 99 enters hub 96 immediately downstream of swirler 98 and extends upstream parallel to circumferential slot 97 until it terminates adjacent liquid fuel passage 44. Lower air cavity 100 preferably enters hub 96 at its upstream end and extends downstream until it terminates adjacent the downstream end of swirler 97.

It will be understood that mixer 24 of combustor 10 may change from operation by gas fuel to one of liquid fuel (and vice versa). During such transition periods, the gas fuel flow rate is decreased (or increased) gradually and the liquid fuel flow rate is increased (or decreased) gradually. Since normal fuel flow rates are in the range of 1000–20,000 pounds per hour, the approximate time period for fuel transition is 0.5–5 minutes. Of course, fuel supply and control mechanism 80 monitors such flow rates to ensure the proper transition criteria are followed.

A centerbody 49 is provided in mixer 24 which may be a straight cylindrical section or preferably one which converges substantially uniformly from its upstream end to its downstream end. Centerbody 49 is preferably cast within mixer 24 and is sized so as to terminate immediately prior to the downstream end of mixing duct 37 in order to address a distress problem at centerbody tip 50, which occurs at high pressures due to flame stabilization at this location. Centerbody 49 preferably includes a passage 51 therethrough in order to admit air of a relatively high axial velocity into combustion chamber 14 adjacent centerbody tip 50. In order to assist in forming passage 51, it may not have a uniform diameter throughout. This design then decreases the local fuel/air ratio to help push the flame downstream of centerbody tip 50.

Inner and outer swirlers 26 and 28 are designed to pass a specified amount of air flow and gas fuel manifold 35 and liquid fuel manifold 40 are sized to permit a specified amount of fuel flow so as to result in a lean premixture at exit plane 43 of mixer 24. By "lean" it is meant that the fuel/air mixture contains more air than is required to fully combust the fuel, or an equivalence ratio of less than one. It has been found that an equivalence ratio in the range of 0.4 to 0.7 is preferred.

As seen in FIG. 2, the air stream 60 exiting inner swirler 26 and outer swirler 28 sets up an intense shear layer 45 in mixing duct 37. The shear layer 45 is tailored to enhance the mixing process, whereby fuel flowing through vanes 34 and/or hub slot 31 are uniformly mixed with intense shear layer 45 from swirlers 26 and 28, as well as prevent backflow along the wall 48 of mixing duct 37. Mixing duct 37 may be a straight cylindrical section, but preferably should be uniformly converging from its upstream end to its downstream end so as to increase fuel velocities and prevent backflow from primary combustion region 62. Additionally, the converging design of mixing duct 37 acts to accelerate the fuel/air mixture flow uniformly, which prevents boundary layers from accumulating along the sides thereof and flashback stemming therefrom. (Inner and outer swirlers 26 and 28 may also be of a like converging design).

Figure 7:
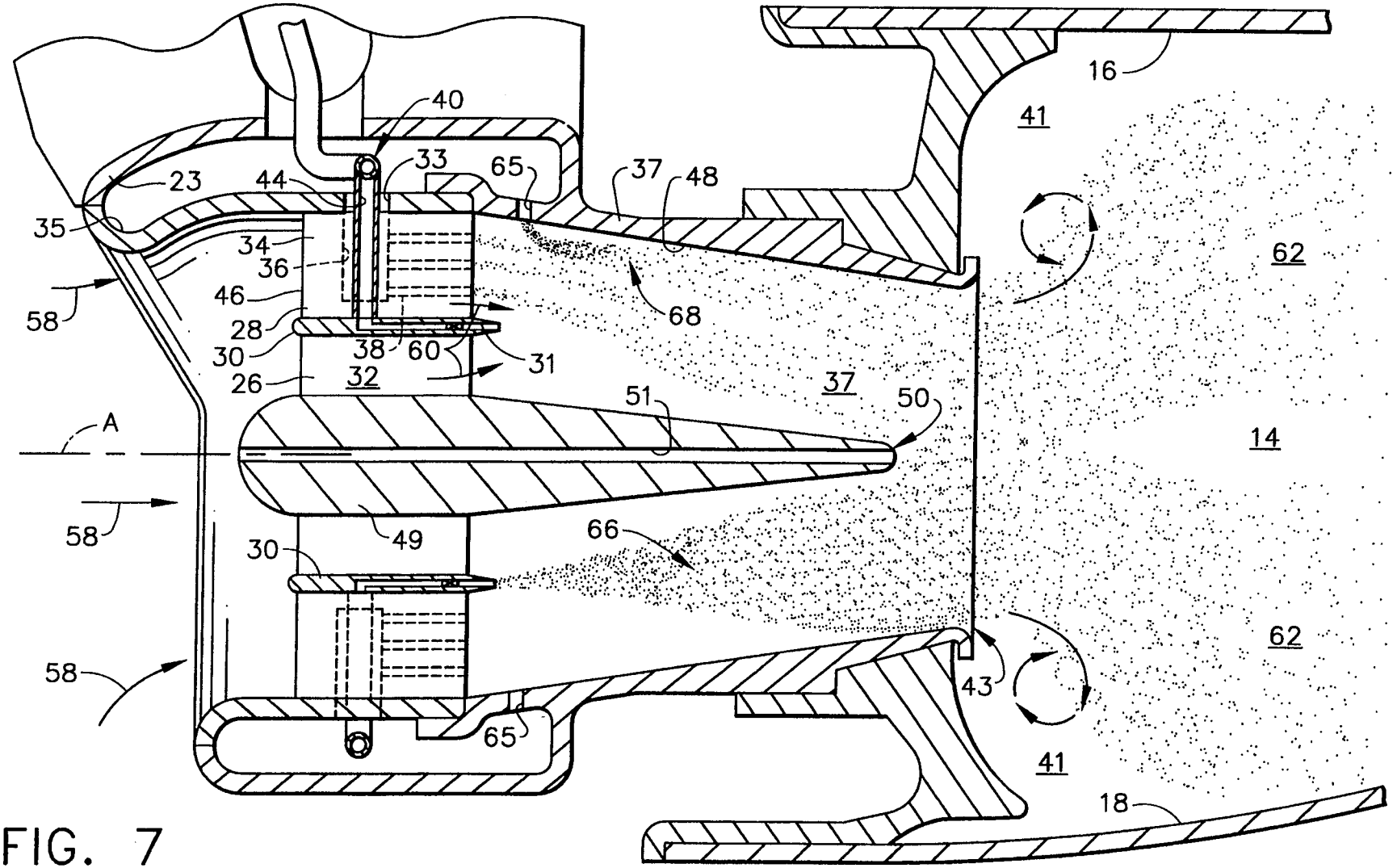
FIG. 7 is an enlarged cross-sectional view of the duel fuel mixer of the present invention which depicts gas fuel flow and mixing in the radial outer half of the mixing duct and liquid fuel flow and mixing in the radial inner half of the mixing duct.

An additional means for introducing fuel into mixing duct 37 is a plurality of passages 65 through wall 48 of mixing duct 37 which are in flow communication with fuel manifold 35 (see FIG. 2). As seen in FIG. 7, passages 65 may be between the wakes of outer swirler vanes 34 (as shown in the upper half of FIG. 7) in order to turn the flow of fuel 68 rapidly along the interior surface of wall 48 of mixing duct 37 to feed fuel to the outer regions of mixing duct 37. Alternatively, passages 65 may be located in line with the wakes of outer swirler vanes 34 (not shown) in order to be sheltered from the high velocity air flow caused by vanes 34, which allows fuel to penetrate further into the air flow field and thus approximately to centerbody 49 within mixing duct 37. In order to prevent boundary layers from building up on passage walls, the cross-sectional area of conical mixing duct 37 preferably decreases from the upstream end to the downstream end by approximately a factor of 2:1.

In operation, compressed air 58 from a compressor (not shown) is injected into the upstream end of mixer 24 where it passes through inner and outer swirlers 26 and 28 and enters mixing duct 37. Gas fuel is injected into air flow stream 60 (which includes intense shear layers 45) from passages 38 in vanes 34 and/or passages 65 in flow communication with fuel manifold 35 and is mixed as shown in the upper half of FIG. 7. Alternatively, liquid fluid is injected into air flow stream 60 from hub slot 31 and mixed as shown in the lower half of FIG. 7. At the downstream end of mixing duct 37, the fuel/air mixture is exhausted into a primary combustion region 62 of combustion chamber 14 which is bounded by inner and outer liners 18 and 16. The fuel/air mixture then burns in combustion chamber 14, where a flame recirculation zone 41 is set up with help from the swirling flow exiting mixing duct 37. In particular, it should be emphasized that the two counter-rotating air streams emanating from swirlers 26 and 28 form very energetic shear layers 45 where intense mixing of fuel and air is achieved by intense dissipation of turbulent energy of the two co-flowing air streams. The fuel is injected into these energetic shear layers 45 so that macro (approximately 1 inch) and micro (approximately one thousandth of an inch or smaller) mixing takes place in a very short region or distance. In this way, the maximum amount of mixing between the fuel and air supplied to mixing duct 37 takes place in the limited amount of space available in an aero-derivative engine (approximately 2–4 inches).

It is important to note that mixing duct 37 is sized to be just long enough for mixing of the fuel and air to be completed in mixing duct 37 without the swirl provided by inner and outer swirlers 26 and 28 having dissipated to a degree where the swirl does not support flame recirculation zone 41 in primary combustion region 62. In order to enhance the swirled fuel/air mixture to turn radially out and establish the adverse pressure gradient in primary combustion region 62 to establish and enhance flame recirculation zone 41, the downstream end of mixing duct 37 may be flared outward as shown in FIG. 7. Flame recirculation zone 41 then acts to promote ignition of the new "cold" fuel/air mixture entering primary combustion region 62.

Alternatively, mixing duct 37 and swirlers 26 and 28 may be sized such that there is little swirl at the downstream end of mixing duct 37. Consequently, the flame downstream becomes stabilized by conventional jet flame stabilization behind a bluff body (.e.g. a perforated plate).

Figure 8:
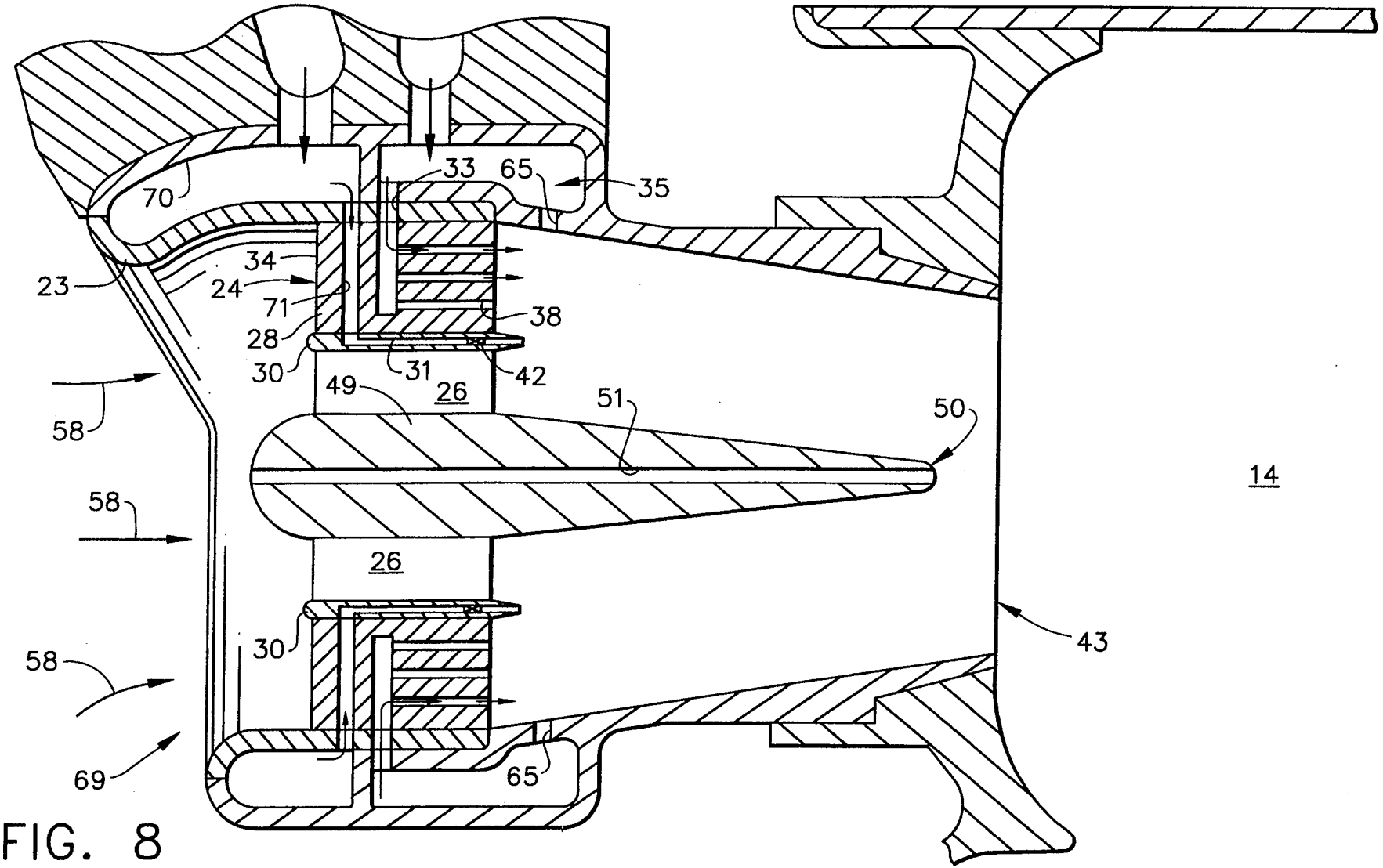
FIG. 8 is a cross-sectional view of an alternate embodiment for the dual fuel mixer of the present invention, where the liquid fuel circuit is external the gas fuel circuit.

An alternative configuration for dual fuel mixer 69 is depicted in FIG. 8. There, liquid fuel manifold 70 is provided within shroud 23 adjacent gas fuel manifold 35 (as opposed to within gas fuel manifold 35). A separate (distinct from gas fuel passage 33) liquid fuel passage 71 is provided through shroud 23 and around outer swirler vanes 34 to the circumferential slot 31 of hub 30, where liquid fuel is then able to be injected into mixing duct 37. Other than the positioning of liquid manifold 70 in shroud 23 and liquid fuel passages 71 around swirler vanes 34 (i.e., the liquid fuel circuit is external of the gas fuel circuit), operation of dual fuel mixer 69 is the same as dual fuel mixer 24.

Figure 10:
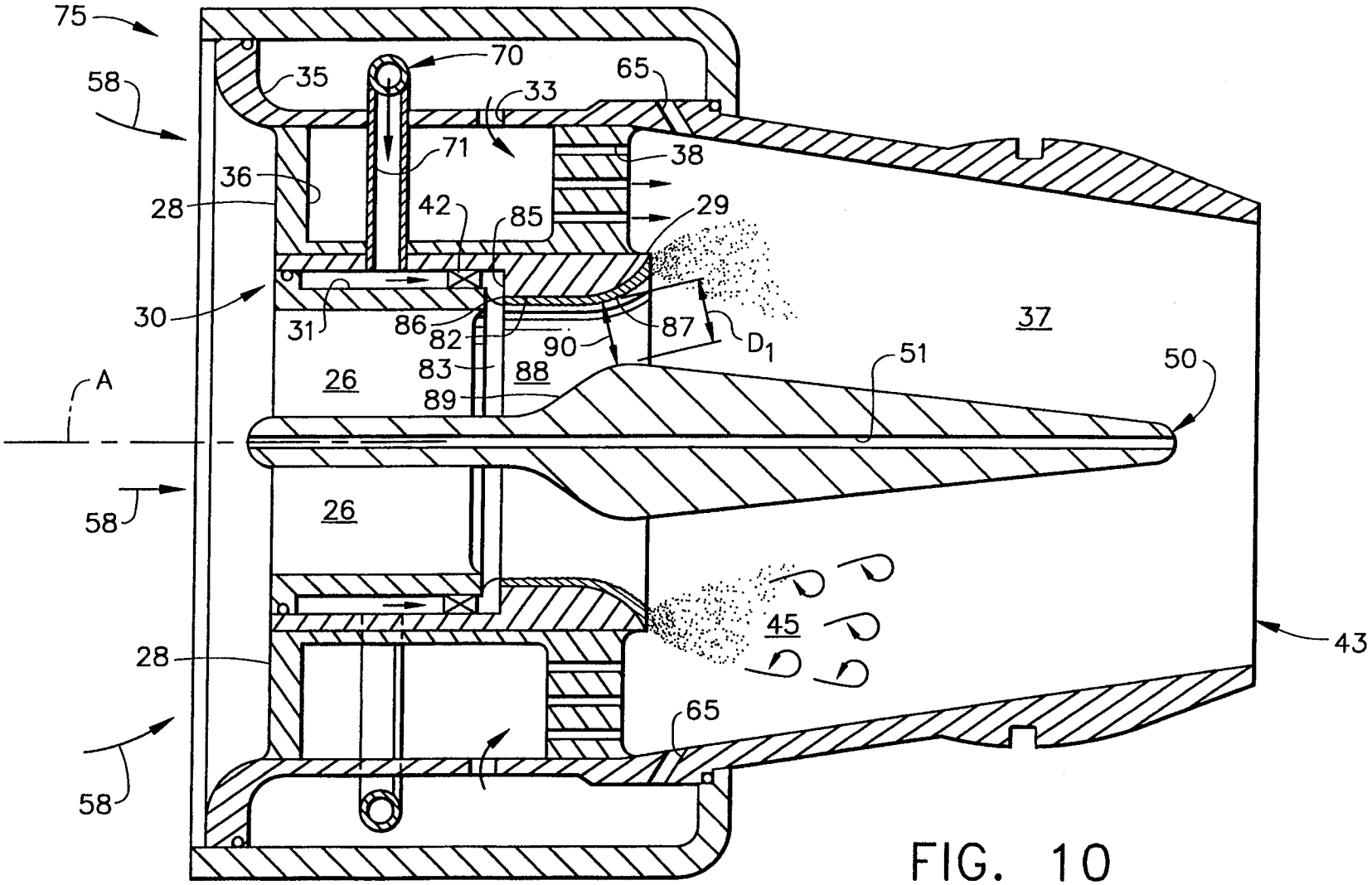
FIG. 10 is a cross-sectional view of an alternate embodiment for the dual fuel mixer of the present invention.

Another embodiment of the dual fuel mixer is shown in FIG. 10, where the circumferential slot 31 in hub 30 does not extend to the downstream end of the hub 30. Rather, circumferential slot 31 extends approximately half the length of hub 30 and preferably terminates adjacent the downstream end of inner annular swirlers 26, where slot 31 then empties into an annular fuel annulus 83. Fuel annulus 83, and the length $L_2$ of circumferential slot 51 from swirler 42 thereto, assures that the liquid fuel is uniformly distributed in a continuous sheet about the circumference of hub slot 31 after exiting swirlers 42 since swirlers 42 impart swirl to the liquid fuel which exits swirlers 42 as distinct jets.

After exiting swirlers 42, the continuous sheet of liquid fuel impacts an upstream facing surface 85 and then flows over a shoulder 86 formed by upstream facing surface 85 and internal surface 82 of the hub 30, and thereafter becomes a fuel film 87 which flows along internal surface 82 of the hub 30. Fuel film 87 is formed by the swirling air provided by inner annular swirlers 26 within cavity 88. As the fuel film 87 reaches the downstream end 29 of the hub 30, it is impacted by the intense shear region 45 created by the opposite swirling airflows of the inner annular swirlers 26 and the outer annular swirlers 28, whereupon the liquid fuel is finely atomized. It should be noted that downstream end 29 is a sharp edge where internal and external surfaces 82 and 81, respectively, of hub 30 meet. Accordingly, sharp downstream end 29 is able to maximize the effect of fuel film 87 entering the shear layer 45 for mixing.

It will be understood that a main objective of the dual fuel mixer 75 in FIG. 10 is to maintain a thin fuel film 87 along hub internal surface 82. In order to accomplish this, other factors beyond the swirling air in cavity 88 are involved, including the placement and cross-sectional area of a throat 90 between a centerbody 89 and hub interior surface 82. As seen in FIG. 10, throat 90 is located slightly upstream of hub downstream end 29 and has a throat area between centerbody 89 and hub surface 82. Centerbody 89 differs in shape from centerbody 49 in FIGS. 1, 2 and 7 in that its upstream end is much narrower which thereafter tapers radially outward from the downstream end of inner annular swirlers 26 to slightly upstream of the downstream end 29 of hub 30. From this point, the centerbody 89 preferably converges substantially uniformly to its downstream end 50.

Figure 11:
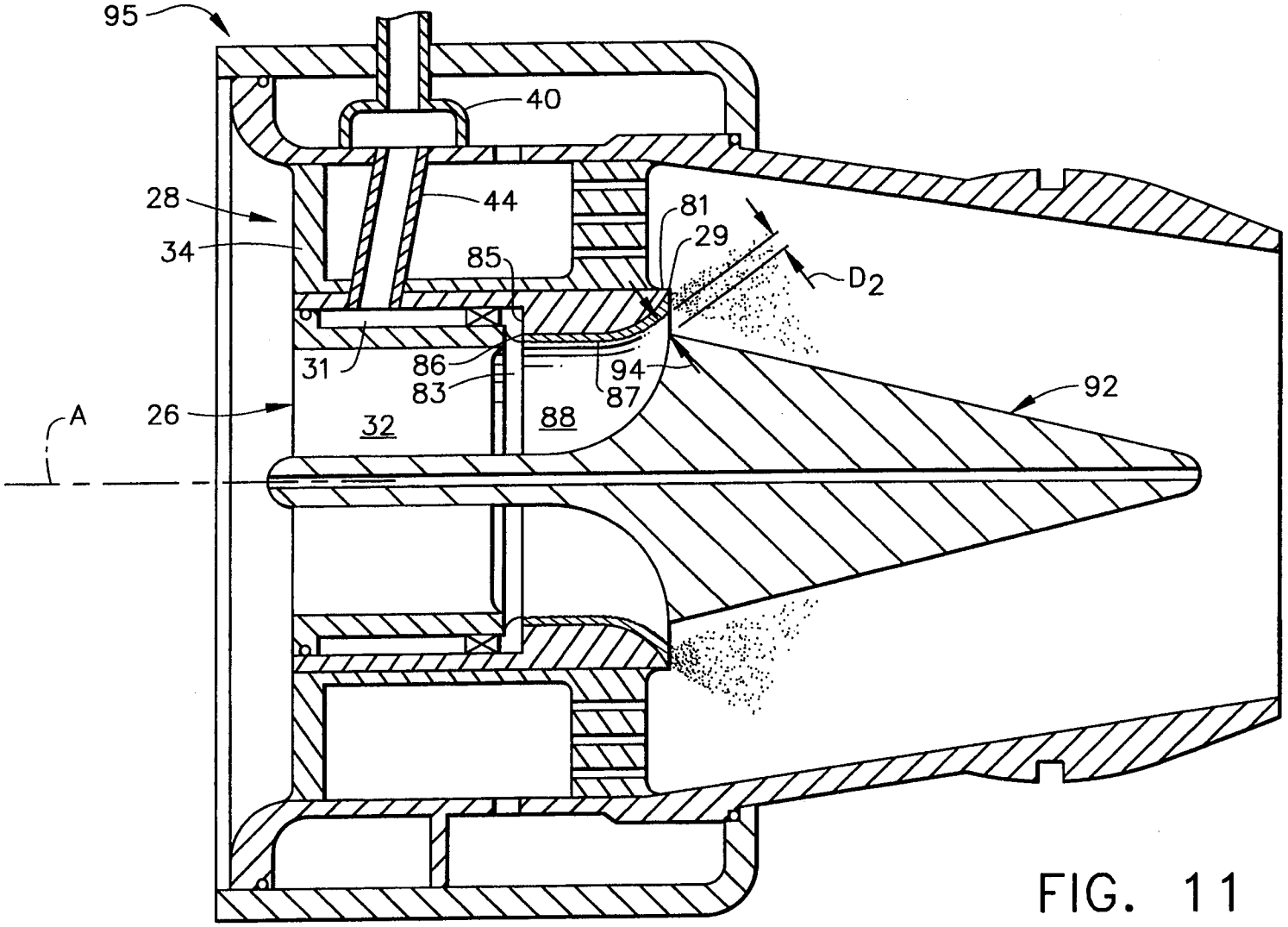
FIG. 11 is a cross-sectional view of the dual fuel mixer depicted in FIG. 8 having a centerbody of an alternative design.

With respect to optimizing the position and cross-sectional area of the throat 90 between centerbody 89 and hub interior surface 82, FIG. 11 depicts a dual fuel mixer 95 of the same general design as that in FIG. 10 with the exception of a modified centerbody 92. Centerbody 92 is configured so that a throat 94 is located approximately at the hub downstream end 29. Further, the throat 94 has a throat area which is comparatively smaller than the throat area of throat 90 (since the distance $D_2$ between centerbody 92 and hub interior surface 82 is smaller than such distance $D_1$, such as 0.1–0.4 inch) and such swirl air better directs the fuel film 87 toward outer annular swirlers 28 at hub downstream end 29. Moreover, the intensity of shear region 45 at hub downstream end 29 is enhanced by the swirling air exiting throat 94. It will be understood that the cross-sectional area of throats 90 and 94 are directly related to distances $D_1$ and $D_2$, as well as the respective radii thereof.

It will be further understood that the dual fuel mixer 95 depicted in FIG. 11 may include liquid manifold 40 and liquid fuel passages 44 within the gas fuel circuit or not, as shown and described in FIGS. 1, 2 and 5 or FIG. 8, respectively.

Having shown and described the preferred embodiment of the present invention, further adaptations of the duel fuel mixer for providing uniform mixing of fuel and air can be accomplished by appropriate modifications by one of ordinary skill in the art without departing from the scope of the invention.

What is claimed is:

1. An apparatus for premixing fuel and air prior to combustion in a gas turbine engine, comprising:

(a) a linear mixing duct having a circular cross-section defined by a wall;

(b) a shroud surrounding the upstream end of said mixing duct, said shroud having contained therein a gas fuel manifold and a liquid fuel manifold, each of said manifolds being in flow communication with a gas fuel supply and a liquid fuel supply, respectively, and control means;

(c) a set of inner and outer annular counter-rotating swirlers adjacent the upstream end of said mixing duct for imparting swirl to an air stream, said outer annular swirlers including hollow vanes with internal cavities, wherein the internal cavities of said outer swirler vanes are in fluid communication with said gas fuel manifold, and said outer swirler vanes having a plurality of gas fuel passages therethrough in flow communication with said internal cavities to inject gas fuel into said air stream, and said outer swirler vanes further including liquid fuel passages therethrough in fluid communication with said liquid fuel manifold; and (d) a hub separating said inner and outer annular swirlers to allow independent rotation thereof, said hub having a circumferential slot in fluid communication with said liquid fuel passages to inject liquid fuel into said air stream; wherein high pressure air from a compressor is injected into said mixing duct through said swirlers to form an intense shear region, and gas fuel is injected into said mixing duct from said outer swirler vane passages and/or liquid fuel is injected into said mixing duct from said hub slot so that the high pressure air and the fuel is uniformly mixed therein, whereby minimal formation of pollutants is produced when the fuel/air mixture is exhausted out the downstream end of said mixing duct into the combustor and ignited.

2. The apparatus of claim 1, further comprising a centerbody located axially along said mixing duct and radially inward of said inner annular swirlers.

3. The apparatus of claim 1, wherein said hub downstream end extends downstream of said outer swirler vanes.

4. The apparatus of claim 1, wherein said hub downstream end is chamfered.

5. The apparatus of claim 1, wherein said liquid fuel manifold is positioned within said gas fuel manifold.

6. The apparatus of claim 5, wherein said liquid fuel passages are positioned within said internal cavities of said outer swirlers.

7. The apparatus of claim 1, further comprising a swirler within said hub slot.

8. The apparatus of claim 1, further comprising means for supplying purge air to said liquid manifold and said liquid fuel passages when gas fuel is being supplied to said mixing duct.

9. The apparatus of claim 1, further comprising means for supplying purge air to said gas manifold and said gas fuel passages when liquid fuel is being supplied to said mixing duct.

10. The apparatus of claim 1, wherein said hub slot extends through a downstream end of said hub.

11. The apparatus of claim 1, wherein said hub slot extends axially through part of said hub and exits radially inward through a passage to an interior surface of said hub.

12. The apparatus of claim 11, said hub passage being located approximately at the downstream end of said inner annular swirlers.

13. The apparatus of claim 11, wherein said hub passage and said hub interior surface form a shoulder, said liquid fuel forming a film which flows downstream along said hub interior surface and being impacted by said intense shear region at the downstream end of said hub.

14. The apparatus of claim 11, wherein a throat is formed between a centerbody and said hub interior surface, said centerbody being located axially along said mixing duct and radially inward of said inner annular swirlers, whereby the velocity of swirling air provided by said inner annular swirlers is increased therethrough.

15. The apparatus of claim 14, wherein said throat is located adjacent said hub downstream end.

16. The apparatus of claim 11, wherein said liquid fuel manifold is positioned within said gas fuel manifold.

17. The apparatus of claim 11, wherein said liquid fuel manifold is adjacent said gas fuel manifold in said shroud.

18. The apparatus of claim 1, further including a plurality of passages through said mixing duct wall terminating downstream of said swirlers, said mixing duct wall passages being in fluid communication with said gas fuel manifold.

19. The apparatus of claim 1, wherein said liquid fuel manifold is adjacent said gas fuel manifold in said shroud.

20. The apparatus of claim 19, wherein said liquid fuel passages are provided external to said outer swirler vanes.

21. The apparatus of claim 4, wherein said circumferential slot converges substantially uniformly from an upstream end of said chamfer to said hub downstream end.

22. The apparatus of claim 1, wherein said hub includes at least one air cavity adjacent said circumferential slot.

23. The apparatus of claim 11, wherein said hub includes at least one air cavity adjacent said circumferential slot.

24. The apparatus of claim 11, wherein inner and outer radial surfaces of said hub form a sharp edge adjacent the downstream end of said outer swirlers.

* * * * *